United States Patent [19]

Lasto et al.

[11] 4,158,528

[45] Jun. 19, 1979

[54] GAS-OPERATED VACUUM TRANSDUCER

[75] Inventors: Clifford S. Lasto, Orange; Raymond A. DuHaime, Huntington, both of Conn.

[73] Assignee: Air-Vac Engineering Co., Inc., Milford, Conn.

[21] Appl. No.: 553,321

[22] Filed: Feb. 26, 1975

Related U.S. Application Data

[63] Continuation-in-part of Ser. No. 396,597, Sep. 12, 1973, abandoned.

[51] Int. Cl.[2] ..... F04F 5/22

[52] U.S. Cl. ..... 417/163

[58] Field of Search ..... 417/54, 163–169, 417/174

[56] References Cited

U.S. PATENT DOCUMENTS

| | | | |
|---|---|---|---|
| 1,152,302 | 8/1915 | Davenport | 417/163 |
| 1,406,145 | 2/1922 | Blauhorn | 417/196 |
| 1,879,366 | 9/1932 | Lorraine | 417/163 |

FOREIGN PATENT DOCUMENTS

| | | | |
|---|---|---|---|
| 177739 | 6/1917 | Canada | 417/163 |
| 450209 | 7/1936 | United Kingdom | 417/164 |

OTHER PUBLICATIONS

*Elements of Gasdynamics*, by Liepmann and Roshko, John Wiley & Sons, Inc., N.Y., 1957, pp. 127 and 129.

*Primary Examiner*—Carlton R. Croyle
*Assistant Examiner*—Edward Look
*Attorney, Agent, or Firm*—Thomas L. Tully

[57] ABSTRACT

There is disclosed a unitary vacuum transducer or pump capable of obtaining a high degree of vacuum using standard shop compressed air fed to a single inlet in the transducer from a single source of compressed air, each venturi tube having compressed air supply means associated with said inlet and terminating in a jet-producing nozzle. The transducer comprises two or more venturi tubes arranged in series with the entrance section of one venturi tube being connected to the exit section of another smaller venturi tube the entrance section of which is connected to the exit section of a yet smaller venturi tube or to the orifice of a vessel containing air or other gas to be rarefied. Compressed air or other gas is supplied at a uniform pressure to the single inlet of the transducer for distribution at a single uniform pressure to the compressed air supply means of each of the venturi tubes to provide a unitary transducer which is capable of producing degrees of vacuum and rates of vacuum flow substantially greater than those now obtainable with standard shop compressed air ranging from 60 psi to 120 psi.

3 Claims, 1 Drawing Figure

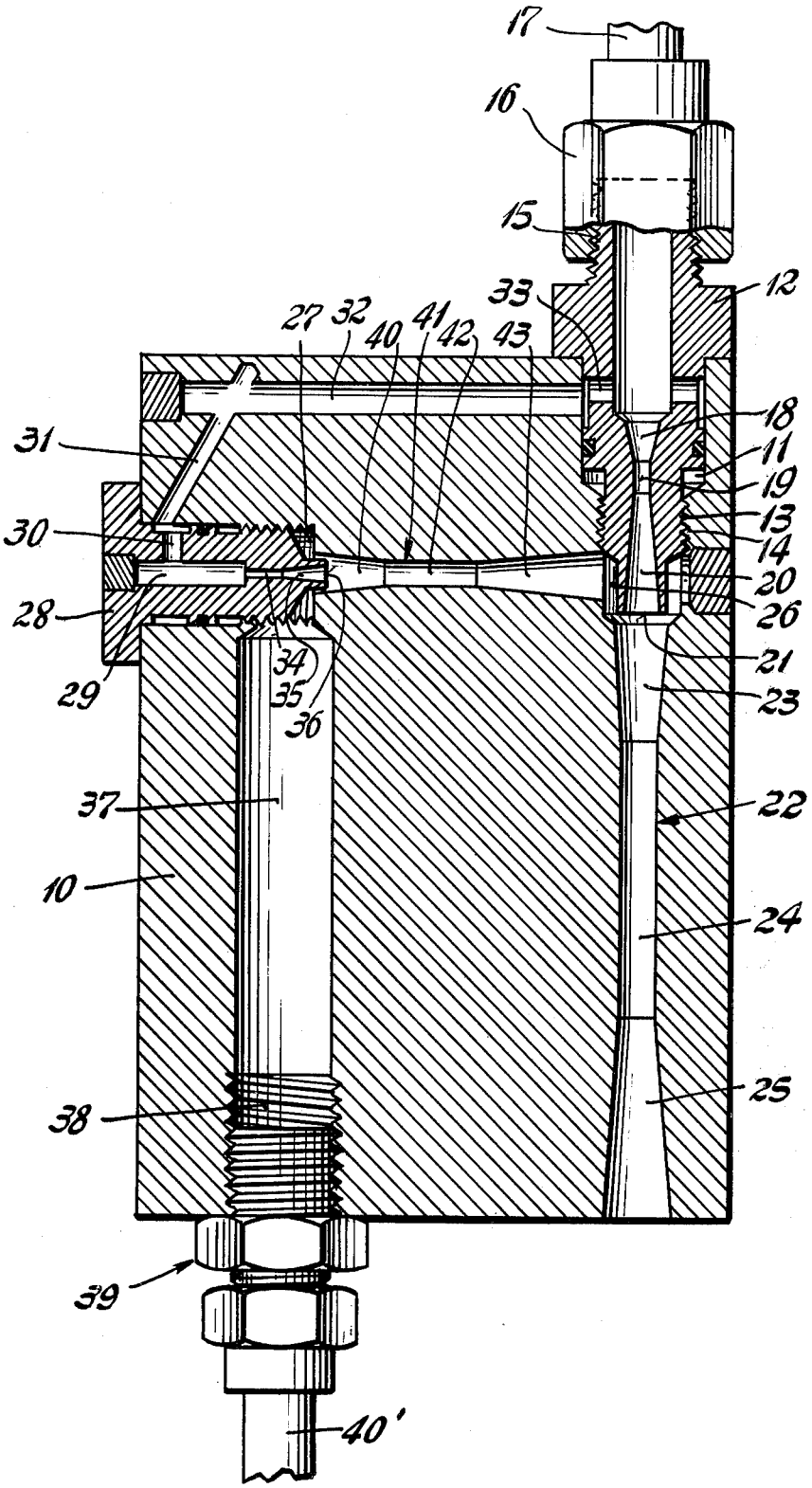
17
16
15
12
33
27
32
40
41
42
43
18
11
19
13
14
20
26
21
23
22
24
25
31
30
28
29
34
35
36
37
10
38
39
40'

GAS-OPERATED VACUUM TRANSDUCER

This application is a continuation-in-part of our application Ser. No. 396,597, filed Sept. 12, 1973, now abandoned.

This invention relates to vacuum transducers operated by a compressed gas such as air at standard shop pressures. Heretofore, if a moderate degree of vacuum was desired, for instance a vacuum of 27" to 28" Hg, in a vessel containing air or other gas, it was possible to obtain such pressures by the use of a venturi tube using standard shop compressed air having pressures from about 60 psi to 120 psi. However, if higher degrees of vacuum were needed, it was necessary to resort to other suction-producing means, such as motor driven mechanical vacuum pumps.

An object of this invention is to provide a unitary air-operated vacuum pump which is capable of producing degrees of vacuum greater than those heretofore possible by the use of compressed air having pressures of standard shop air, that is pressures of 60–120 psi fed to the pump through a single inlet. With a vacuum pump of the present invention so powered, it is possible to produce a maximum degree of vacuum up to about 0.25 inch of a perfect vacuum regardless of atmospheric conditions, without the need to use motor driven mechanical vacuum pumps.

As illustrated in the drawing, a vacuum transducer of the present invention based upon two venturi tubes creates an absolute pressure of 0.25" Hg with air consumption of only 3.1 scfm with air supply pressure of approximately 60 psi, and a vacuum flow of 1.4 scfm.

This is accomplished by the present invention by providing a unitary pump comprising one venturi tube, herein termed the first venturi tube, another smaller venturi tube, herein termed the second venturi tube and, if desired, a third or fourth venturi tube, each one proportionately smaller than the venturi tube to which it is connected, compressed air supply means for supplying said air from a single source at a single pressure to each of said venturi tubes, and air-conducting means connecting the entrance section of the larger venturi tube to the exit section of the next smaller venturi tube to which it is directly connected whereby the suction effect of each larger venturi tube increases the negative air pressure i.e. provides a more perfect vacuum at the exit orifice of the next smaller venturi tube and thus causes that venturi tube to create a larger negative pressure, i.e., increase the vacuum in an air-conditioning conduit, substantially more than would be the case if there were provided a single venturi tube.

One important industrial use for the transducer is in static applications where the atmosphere holds a sheet, for instance, positioned over a cavity in which the vacuum force is effective on the underside of the sheet in so-called vacuum forming, especially of plastic material; also in a vacuum furnace in which it is important to reduce the air content to a minimum.

The accompanying drawing is a sectional view of one form of the transducer of the present invention based upon two venturi tubes.

As shown in the accompanying drawing, the vacuum transducer of the present invention comprises a body 10 of any suitable material, plastic material being satisfactory, having a cavity 11 for receiving a nozzle 12 having a screw-threaded neck 13 screwed into a threaded hole 14 of the body 10 to secure the nozzle 12 to the body.

The upper portion of the nozzle 12 has threads 15 to receive a fitting 16 on a hose or pipe 17 through which compressed air is fed to the nozzle.

The nozzle 12 has a converging entrance section 18, a restricted throat 19 and a diverging exit section 20 having an orifice 21. The orifice 21 opens into a venturi tube 22 having a converging entrance section 23, a restricted throat 24 and a diverging exit section 25 which is open to the atmosphere at the bottom of the body 10.

When compressed air is fed through the converging entrance passage 18, it is further compressed as it passes to and through the restricted throat 19 so that its velocity increases. The air passes out of the throat as a jet stream into and through the diverging exit section 20 with virtually no loss of velocity. As the jet of air leaves the orifice 21 and passes into and through the converging passage 23 and the restricted throat 24 of the venturi tube 22, the velocity of the jet stream creates a vacuum in the converging passage 23. The jet stream then enters into the diverging exit passage 25 of the venturi tube 22 and escapes to the atmosphere.

The rapidly traveling jet of air passing through the venturi tube 22 produces a substantial negative gauge pressure thereby creating a vacuum in chamber 26 surrounding the orifice 21.

To produce negative gauge pressure, i.e., partial vacuum in a vessel containing air or other gas, it was the custom heretofore to provide means to connect the venturi tube to a vessel in which air pressure is to be reduced, but, as stated above, the degree of vacuum obtainable with a venturi tube with the use of standard shop compressed air was limited to absolute pressure of 2–3" Hg.

According to the present invention, however, this limitation was overcome by the use of two or more venturis having different gas-flow consumptions, and, as shown herein, connecting the venturis in series to the conduit or confined space in which air pressure is to be reduced. For this purpose, as shown in the drawing, the body 10 of the transducer has a cavity 27 for receiving a second venturi comprising a jet nozzle 28 which has an air passage 29 connected by a port 30 in the nozzle 28, passages 31 and 32 in the body 10 and port 33 in the nozzle 12 which, as stated above, is connected to a source of compressed air by hose or pipe 17. Thus, it will be seen that both jet nozzle 12 of the first venturi and jet nozzle 28 of the second venturi are connected to the same source of compressed air which may be taken from an air line in a shop, for instance. The second nozzle 28 also has a restricted throat 34 and a diverging exit passage 35 having an orifice 36. In the form of the invention herein shown the body 10 has a passage 37, one end of which has screw threads 38 to be engaged by a fitting 39 adapted to be connected as by a hose 40' to a conduit or confined space the air pressure of which is to be reduced.

For purposes of clarity it should be pointed out that the term "venturi" as used herein refers to the combination of the jet nozzle, including its restricted throat and diverging passage, and the venturi tube into which gas enters from said nozzle. Thus the first venturi comprises nozzle 12 with its throat 19 and exit section 20 and venturi tube 22 while the second venturi comprises nozzle 28 with its throat 34 and exit passage 35 and venturi tube 41.

In use, the compressed air from the nozzle 12 of the first venturi flows through the port 33, passages 32 and 31 in the body 10, port 30 and passage 29 in the nozzle 28 of the second venturi. The air in passing through the restricted throat 34 is issued as a jet stream through the diverging passage 35 without substantially losing pressure or velocity. As the jet of air leaves the orifice 36, its velocity is such that it creates an absolute pressure equal to 0.25" Hg. It then flows into the converging passage 40 of the smaller venturi tube 41 where it passes through a restricted throat 42 and into a diverging section 43 to a chamber 26 which surrounds orifice 21.

The rapidly moving jet from the nozzle 28 passing through the smaller venturi tube 41 produces a "substantial" negative pressure thereby creating a 29.75" Hg vacuum in a chamber 27 surrounding the orifice 36 with the result that the pressure in passage 37 leading to the conduit 40' is reduced. This reduction is substantial because the pressure of air in the second venturi tube 41 is reduced by the operation of the jet stream entering the first venturi tube 22 and the suction of the latter.

The most critical limitation of the present invention is the requirement that each of the venturis which are united in series must have a predetermined gas-flow consumption relationship within relatively close limits with respect to the venturi to which it is connected. The smaller or smallest venturi is directly associated with the vacuum line, and the larger venturi to which it is connected has a gas-flow consumption which is about 5 to 15 times greater than the gas-flow consumption of the smaller venturi, and preferably about 10 times greater. This same relationship applies to any one or more additional venturis which are connected in series to the system. Thus, each additional venturi will have the entrance section of its venturi tube connected to the exit section of the previous venturi tube, will be connected to a common source of compressed gas and will have an air-flow consumption which is from 5 to 15 times greater, and most preferably 10 times greater, than the air-flow consumption of the venturi which exhausts thereinto.

The gas-flow consumption of each venturi is directly related to the dimensions of its jet nozzle and its venturi tube, most particularly the relative diameter and length of the throats of each, and larger venturis have greater gas-flow consumptions than smaller venturis as is well known to those skilled in the art.

When venturis having the same-gas flow consumption are connected in series no improvement or increase in vacuum is obtained over the use of either one alone. Similarly, when venturis having smaller or larger gas-flow consumptions, outside the range of from 5 to 15:1, are used in series no important increase in vacuum is obtained over the use of either one alone. The gas-flow consumption relationship taught herein is necessary to obtain absolute pressure of 1" Hg or less, down to about 0.25" Hg or less, without the need for supplemental devices such as mechanical vacuum pumps.

Another important advantage of the present unitary vacuum transducers is their relatively high ratio of vacuum flow to gas flow, equaling at least about 0.25 to 1, which assists in the rapid creation of the vacuum by permitting rapid removal of atmospheric air from the conduit or vessel being rarefied. Preferably a vacuum flow of about 1.33 scfm is provided with a gas-flow consumption of about 4.2 scfm at 80 psi to provide a ratio of about 0.31 to 1.

As stated hereinbefore, it is possible with the improved vacuum transducers of the present invention to provide a more perfect vacuum than heretofore possible by means of venturi devices. The preferred embodiment of the invention involves the use of only two venturis in series to provide a negative gauge pressure of at least 1" Hg absolute and down to about 0.25" Hg absolute, regardless of ambient conditions. The use of one or more additional venturis in series provides some small decrease of the negative gauge pressure, below about 0.25" Hg absolute, but the improvement in result is generally not substantial enough to justify the increased cost of production except in exceptional cases where the small improvement is critical. However, in any event, the same concept applies to the use of a succession of venturis connected in series, namely the fact that the efficiency of one venturi in creating a vacuum can be improved substantially by directing the gas flow from the exit section of that venturi into the entrance passage of a larger venturi having a gas-flow consumption which is from 5 to 15 times greater than the gas-flow consumption of the one venturi and which is operating at full gas-flow consumption.

We have discovered that the pressure of the compressed air supplied to the vacuum transducer of the present invention may vary substantially, for instance from 60 to 120 psi with substantially no change in the degree of vacuum or vacuum flow, but there is a substantial change in the volume of compressed air consumed.

Variations and modifications may be made within the scope of the claims and portions of the improvements may be used without others.

We claim:

1. An air-operated vacuum transducer which provides a relatively high ratio of vacuum flow to gas flow of at least 0.25 to 1 for creating a vacuum of from at least 1" Hg absolute down to less than 0.25" Hg absolute in a conduit having a gas exit cavity, said transducer comprising a first venturi and a smaller second venturi, said first venturi having a larger jet nozzle and a restricted throat section of greater length and diameter than said second venturi whereby said first venturi has an air-flow consumption which is from 5 to 15 times greater than the air-flow consumption of said second venturi, each said venturi comprising a jet nozzle and a venturi tube comprising a converging gas entrance section, a restricted throat section and a diverging gas exit section, the entrance section of the second venturi tube being in communication with the outlet of the conduit from which gas is to be drawn as vacuum flow to create a negative gauge pressure in said conduit, the gas exit section of the second venturi tube being in close gas-conducting relation with a chamber connected with the gas entrance section of the first venturi tube, the first venturi having a jet nozzle having a converging entrance passage, a restricted passage and a diverging exit passage opening into said converging passage of said first venturi tube for directing a jet of air under pressure through said first venturi tube at a determinate velocity sufficient to create a negative gauge gas pressure in said chamber and in the second venturi tube, and the second venturi having a jet nozzle having a restricted passage and a diverging exit passage which opens into the converging passage of said second venturi tube for directing a jet of air under pressure through said second venturi tube at a determinate velocity sufficient to increase the negative gauge air pressure to a value of from at least 1" Hg absolute down to less than 0.25" Hg absolute in said chamber, in said second venturi tube and at the outlet of said conduit, and an air conduit connecting the intake side of said first jet nozzle to the intake side of said second jet nozzle whereby air under pressure of from 60 psi to 120 psi supplied to said first jet nozzle as air flow is simultaneously supplied at the same pressure to said second jet nozzle by means of said gas conduit.

2. An air-operated vacuum transducer according to claim 1 in which said first and second venturis comprising said venturi tubes and jet nozzles are present in a unitary body.

3. An air-operated vacuum transducer according to claim 1 for creating a vacuum of 0.25" Hg absolute in which the air-flow consumption of said first venturi tube is 10 times greater than the air-flow consumption of said second venturi tube.

* * * * *